US011998088B2

(12) United States Patent
Evans et al.

(10) Patent No.: US 11,998,088 B2
(45) Date of Patent: Jun. 4, 2024

(54) BELT BUCKLE

(71) Applicant: Edge-Works Manufacturing Company, Burgaw, NC (US)

(72) Inventors: Scott V. Evans, Jacksonville, NC (US); Nicholas R. Tomczak, Richlands, NC (US)

(73) Assignee: Edge-Works Manufacturing Company

( * ) Notice: Subject to any disclaimer, the term of this patent is extended or adjusted under 35 U.S.C. 154(b) by 0 days.

(21) Appl. No.: 18/081,815

(22) Filed: Dec. 15, 2022

(65) Prior Publication Data

US 2023/0131726 A1 Apr. 27, 2023

Related U.S. Application Data

(63) Continuation of application No. 17/092,676, filed on Nov. 9, 2020, now Pat. No. 11,553,764, which is a continuation of application No. 16/225,166, filed on Dec. 19, 2018, now Pat. No. 10,856,626, which is a continuation-in-part of application No. 29/632,512, filed on Jan. 8, 2018, now Pat. No. Des. 860,858.

(51) Int. Cl.

| | |
|---|---|
| ***A44B 11/10*** | (2006.01) |
| ***A44B 11/00*** | (2006.01) |
| ***A44B 11/06*** | (2006.01) |

(52) U.S. Cl.

CPC ..... *A44B 11/10* (2013.01); *A44B 11/006* (2013.01); *A44B 11/06* (2013.01)

(58) Field of Classification Search

CPC ..... A44B 11/10; A44B 11/06; A44B 11/006; A44B 11/12; A44B 11/08; A44B 11/2557; Y10T 24/4084; Y10T 24/4086; Y10T 24/4093; Y10T 24/4019

See application file for complete search history.

(56) References Cited

U.S. PATENT DOCUMENTS

| | | | | |
|---|---|---|---|---|
| 2,317,571 A * | 4/1943 | White | ..... | A44B 11/04 24/171 |
| 2,542,044 A * | 2/1951 | Miller | ..... | A44B 11/10 24/196 |
| 2,743,497 A * | 5/1956 | Davis | ..... | A44B 11/10 24/196 |
| 2,754,560 A * | 7/1956 | Warner | ..... | B64D 17/32 24/196 |

(Continued)

*Primary Examiner* — Jonathan Malikasim
*Assistant Examiner* — Rowland Do
(74) *Attorney, Agent, or Firm* — Intellectual Property Consulting, LLC; Stephen M. Kepper

(57) ABSTRACT

A buckle having an adjustable loop end forming a primary plane with opposing side walls. The adjustable loop end has a central bar positioned between a first strap opening and a second strap opening. A pair of slots operable to receive the terminal ends of the central bar are recessed into the interior surface of the opposing side walls with the bottom edges of the slots being longer than the top edges. A pair of tabs on opposite ends of the central bar extend outward from the central bar along a longitudinal axis of the primary plane and towards the second strap or belt opening. Optionally, a protrusion extends from a lower surface of the fixed loop end wherein the protrusion is positioned at a right angle with respect to a vertical axis of the primary plane.

6 Claims, 9 Drawing Sheets

(56) References Cited

U.S. PATENT DOCUMENTS

| | | | | | |
|---|---|---|---|---|---|
| 3,161,931 | A * | 12/1964 | Zif | A44B 11/04 | 24/200 |
| 3,293,713 | A * | 12/1966 | Gaylord | A44B 11/10 | 24/196 |
| 3,407,451 | A * | 10/1968 | Dewey | B64D 17/32 | 24/196 |
| 3,591,900 | A * | 7/1971 | Brown | A44B 11/10 | 24/196 |
| 4,525,901 | A * | 7/1985 | Krauss | A44B 11/04 | 24/200 |
| 4,608,735 | A * | 9/1986 | Kasai | A44B 11/10 | 24/194 |
| 4,699,747 | A * | 10/1987 | Lovato | A44B 11/10 | 264/328.8 |
| 4,791,709 | A * | 12/1988 | Fildan | A44B 11/266 | 24/171 |
| 4,878,271 | A * | 11/1989 | Kitokovsky | B60R 22/30 | 24/194 |
| 4,903,378 | A * | 2/1990 | Kasai | A44B 11/10 | 24/171 |
| 5,285,555 | A * | 2/1994 | Bell | A44B 11/10 | 24/194 |
| 5,590,443 | A * | 1/1997 | Fildan | A44B 11/02 | 24/200 |
| D611,710 | S * | 3/2010 | Paik | D3/318 | |
| 2011/0016678 | A1* | 1/2011 | Bergkvist | A44B 11/10 | 24/682.1 |
| 2011/0173781 | A1* | 7/2011 | Steck | A44B 11/10 | 24/164 |

* cited by examiner

BELT BUCKLE

RELATED APPLICATIONS

This application is a continuation of U.S. application Ser. No. 17/092,676, filed Nov. 9, 2020, which is a continuation of U.S. application Ser. No. 16/225,166, filed Dec. 19, 2018, now U.S. Pat. No. 10,856,626, which is a continuation-in-part of U.S. Design patent application No. 29/632,512, filed Jan. 8, 2018, now Pat. No. Des. 860,858. The entire contents of the above application are hereby incorporated by reference as though fully set forth herein.

FIELD

The present invention relates to the field of buckles. More specifically, the present invention relates to fasteners for adjustably interconnecting belts or straps.

BACKGROUND

Various adjustable strap fasteners or buckles are known in the prior art which may be manipulated to adjust the effective length of a strap as used on, for example, a safety harness line. Such fasteners are usually made of a plastic or metal material and formed into an integral molded structure which generally comprises a fixed loop end and adjustable loop end. In use, one strap end portion is looped through a strap or belt opening on the fixed loop end and secured in place as by stitching or rivetting. The other strap end portion which is adapted for length adjustment is looped through one belt or strap opening on the adjustable loop end, around a central cross bar and looped back through a second strap or belt opening on the adjustable loop end and frictionally gripped therebetween against displacement.

The belt buckles known in the prior art are not able to withstand higher loads and pressure against the adjustable loop central cross bar. Further, these buckles are not easily worn close against the body of a user as they tend to flip upwards when a force is applied against them

BRIEF SUMMARY OF THE INVENTION

It is the object of the present invention to address several challenges in previous attempts to achieve increased stability and load capacity with a load applied via belts or straps and mounted with a buckle.

A buckle according to the present invention has an adjustable loop end forming a primary plane. A first strap or belt opening extends through the adjustable loop end along a portion of a lateral axis of the primary plane. A second strap or belt opening extends through the adjustable loop end along a portion of the lateral axis of the primary plane. A central bar is positioned between the first strap or belt opening and second strap or belt openings along the lateral axis of the primary plane. A pair of tabs on opposite ends of the central bar extend outward from the central bar along a longitudinal axis of the primary plane and towards the second strap or belt opening.

In some embodiments, a protrusion extends from a lower surface of the fixed loop end wherein the protrusion is positioned at a right angle with respect to a vertical axis of the primary plane.

In other embodiments, a male joint portion extends outward from the central bar along the longitudinal axis of the primary plane and towards the first strap or belt opening and a female joint portion is recessed into the adjustable loop end along the longitudinal axis of the primary plane and away from the first strap or belt opening.

In other embodiments, a scalloped lip is along a leading edge of a lower surface of the adjustable loop end. Further, the perimeter of the buckle has at least one curved edge.

DETAILED DESCRIPTION

Figure 1:
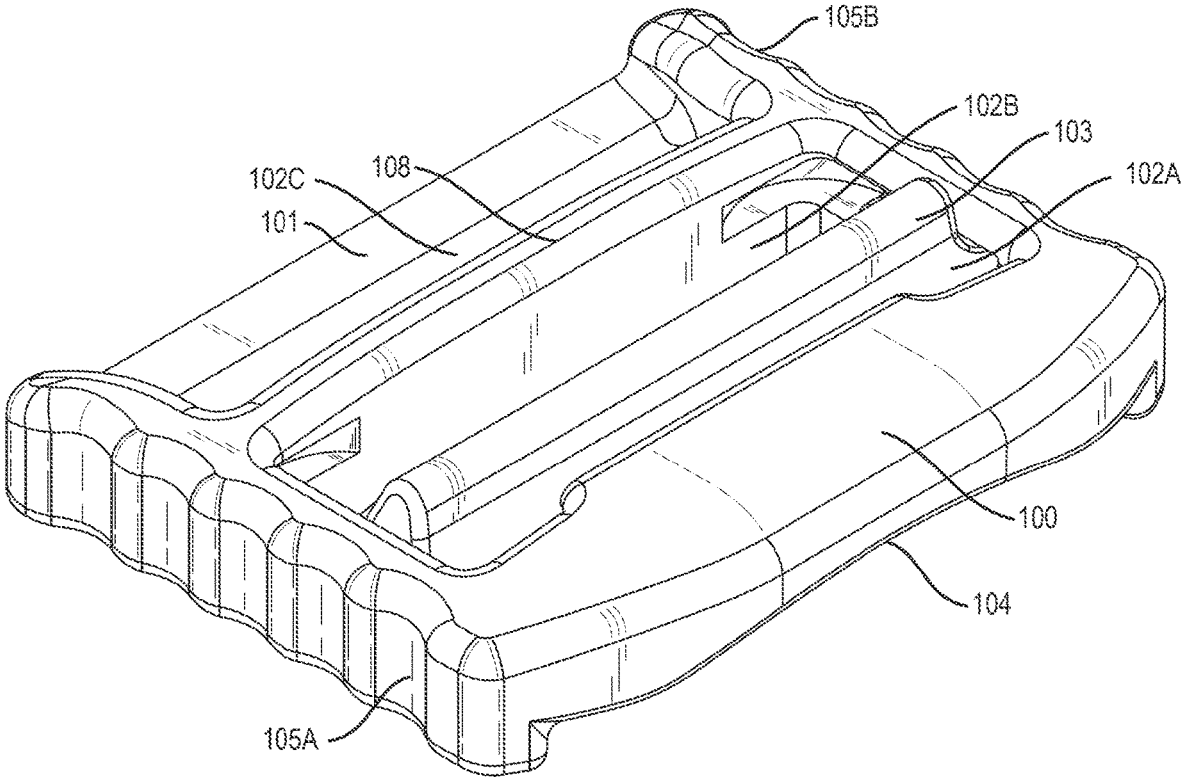
FIG. 1. is a perspective front view of the buckle of the present invention.

Turning to FIG. 1, the buckle according to the preferred embodiment of the present invention comprises a fixed loop end 101 and an adjustable loop end 100 connected to each other as one contiguous piece to create a common primary plane which are separated by cross bar segment 108. In an alternative embodiment, one of the fixed loop or adjustable loop ends 100, 101 forms a female locking piece and the complimentary end forms a male locking piece wherein the two ends interlock in the inserted state using locking mechanisms known in the prior art, such as a stab lock mechanism.

Figure 12:
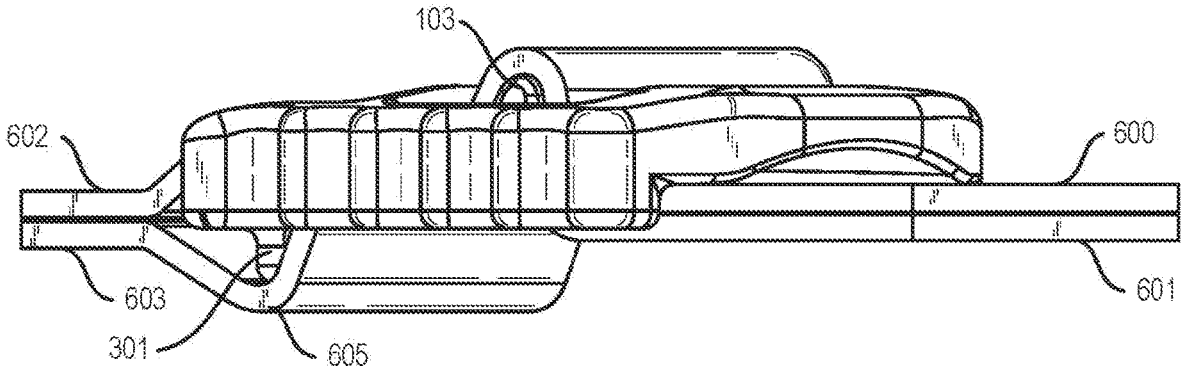
FIG. 12. is a perspective side view of the present invention.

The fixed loop end 101 and the adjustable loop end 100 are each provided with at least one strap or belt opening 102A, 102B, and 102C for guiding a strap or belt 600, 601, 602 and 603 (Shown in FIGS. 6, 7 and 12) to be connected with the fixed loop end 101 and/or the adjustable loop end 100.

In the exemplary embodiment shown herein, the fixed loop end 101 has only one strap or belt opening 102C to connect a strap or belt in a fixed manner to the fixed loop end 101 (by guiding it through the strap or belt opening 102C and sewing it), while the adjustable loop end 100 has two strap or belt openings 102A, 102B, located at both sides of a displaceable central bar 103, in order to connect a strap or belt to the adjustable loop end 100 in an adjustable fashion. Here, the end of the strap or belt is pulled in a manner known from the rear lower surface of the adjustable loop end 100 through the strap or belt opening 102B, over the central bar 103, and further through the strap or belt opening 102A.

As shown in FIGS. 1-6 and 10-12, in the preferred embodiment of the present invention the entire perimeter of the buckle has a curved profile. Although it may appear to merely be an aesthetic feature of the buckle design, the curved profile rather than a traditional block profile allows the buckle to feel and look less heavy even though it still has mass necessary to match and even exceed the strength and resilience of the traditional block design. As the mass is removed from the top surface as loop end 100 slopes downward towards the lift tab 104 as well as from the bottom surface below the lift tab 104 as it moves away from the stress point.

Figure 2:
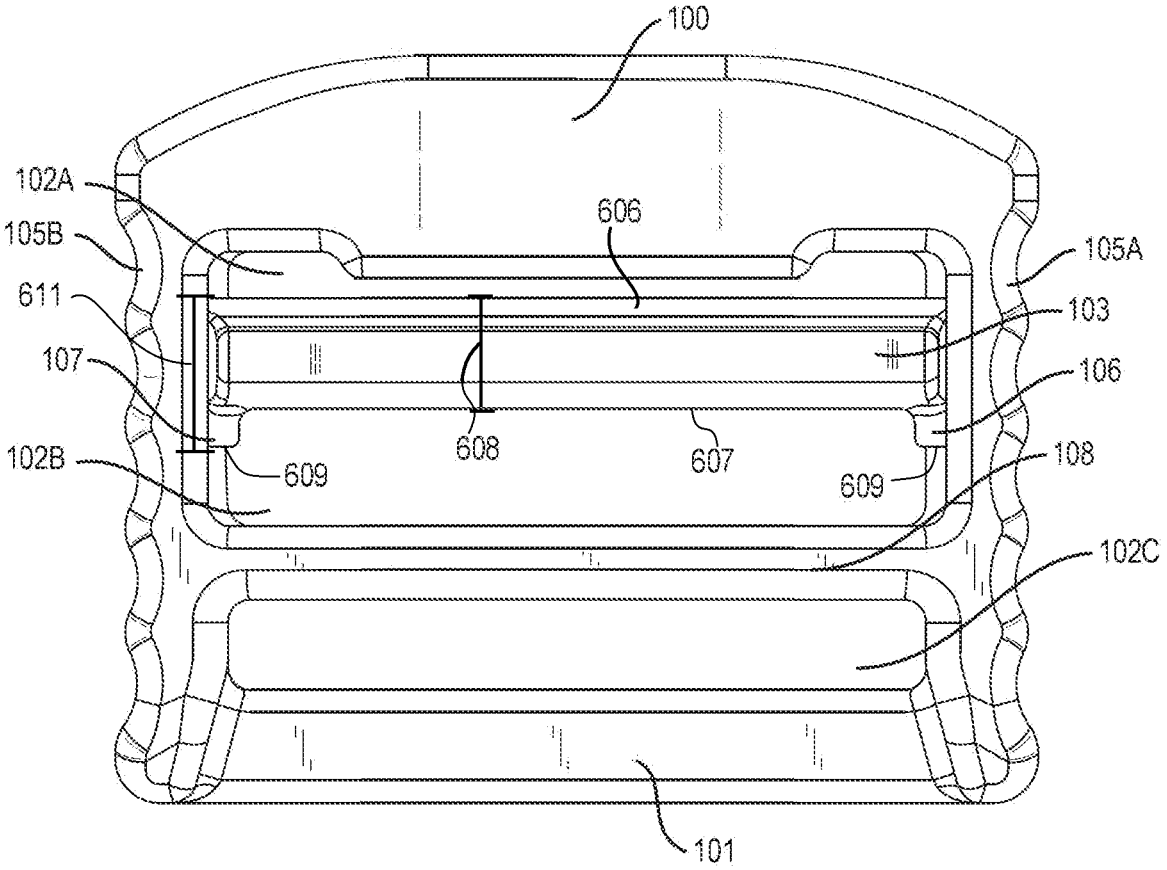
FIG. 2. is a top view of the buckle of the present invention.
Figure 3:
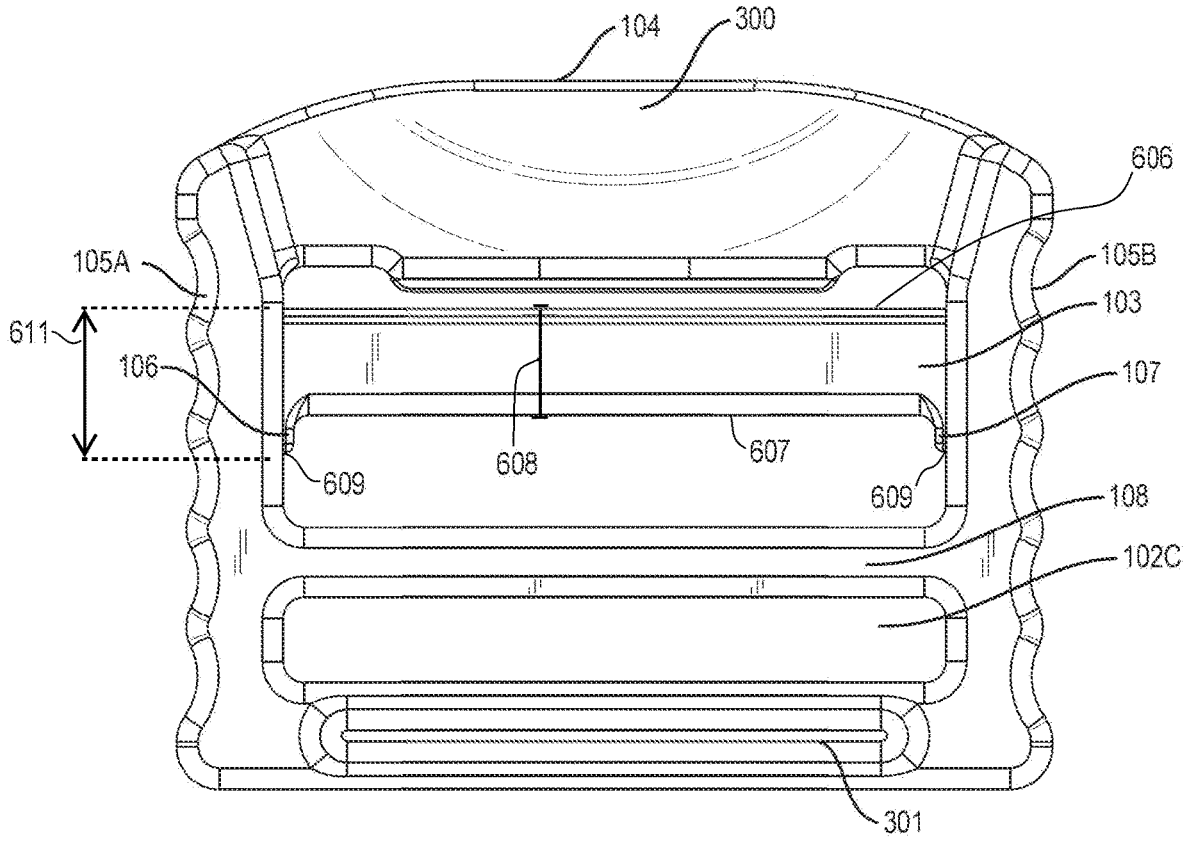
FIG. 3. is a bottom view of the buckle of the present invention.
Figure 4:
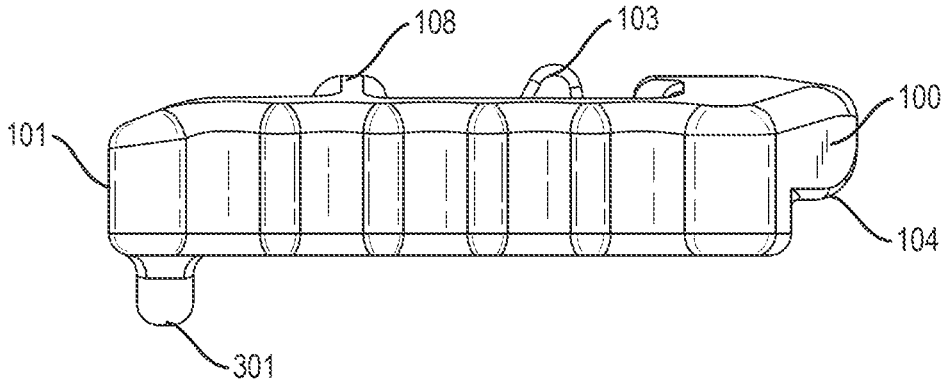
FIG. 4. is a right side view of the buckle of the present invention.
Figure 5:
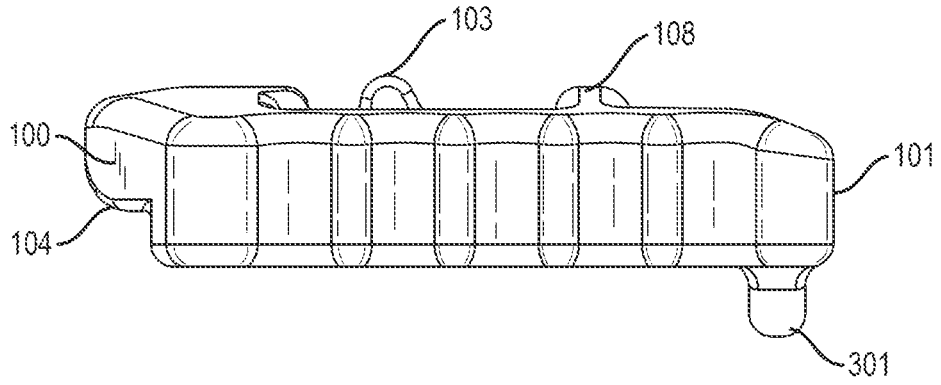
FIG. 5. is a left side view of the buckle of the present invention.
Figure 9:
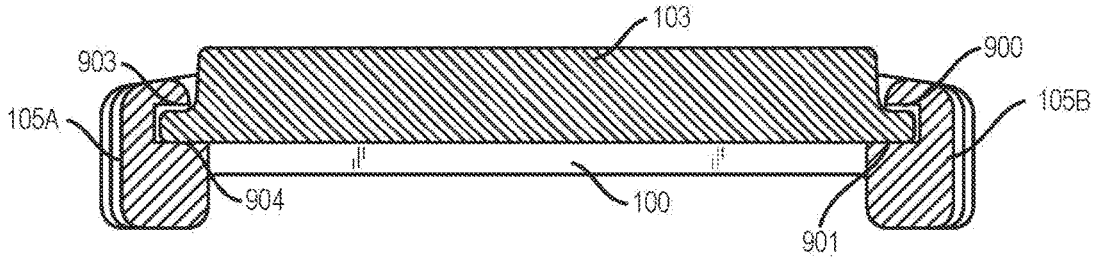
FIG. 9. is a cross section view of the buckle of the present invention.
Figure 10:
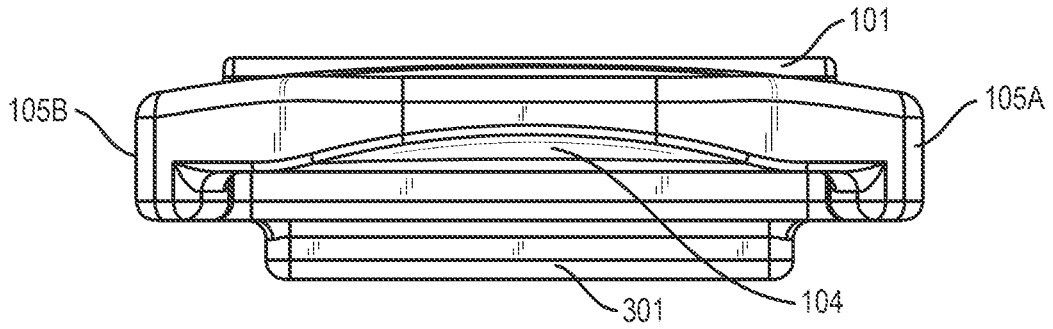
FIG. 10. is a front view of the buckle of the present invention.
Figure 11:
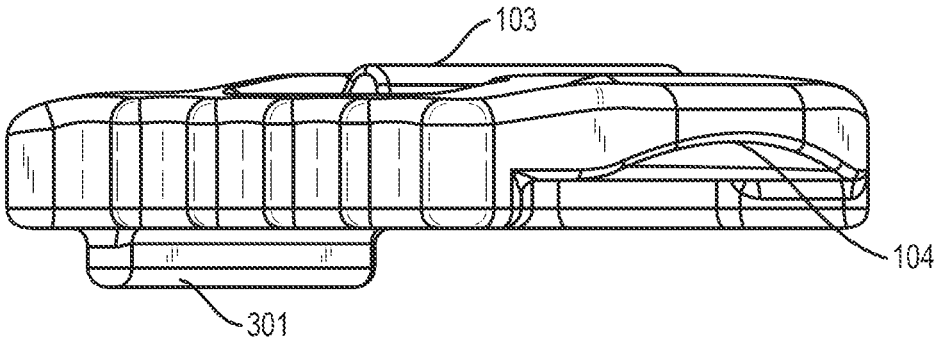
FIG. 11. is a perspective side view of the present invention.

As shown in FIGS. 1-3, the adjustable loop end 100 has a pair of opposing side walls 105A and 105B. Turning to FIG. 9, the cross section of the adjustable loop end 100 along the lateral axis, a pair of opposing slots are recessed into the interior surface of the opposing side walls 105A and 105B. The bottom edges of the slots 901 and 904, are longer than the top edges 900 and 903; respectively, such that the edges are offset along the vertical axis. In a conventional adjustable buckle, the edges are aligned along the vertical axis. The offset of the top and bottom edges allows the thicker sections of the central bar 103 to rest in the slots. This configuration removes the load from the thin tabs of the locking bar and places it on the thicker, stronger part of the locking bar to allow for a much higher load capacity.

As shown in FIGS. 4-8 and 10-12, the fixed loop end 101 has a protrusion 301 on the rear lower surface such that the protrusion 301 is positioned at about a right angle with respect to the vertical axis of the fixed loop end 101. As shown more specifically in FIGS. 10-11, in the preferred embodiment, the protrusion 301 extends across at least a portion of the lateral axis of the fixed loop end 101 and at least a portion of the longitudinal axis of the fixed loop end 101.

Figure 6:
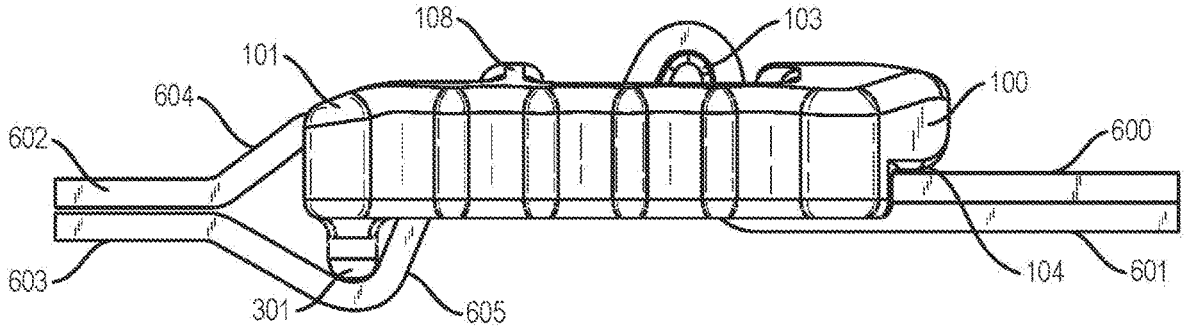
FIG. 6. is a right side view of the buckle of the present invention.
Figure 7:
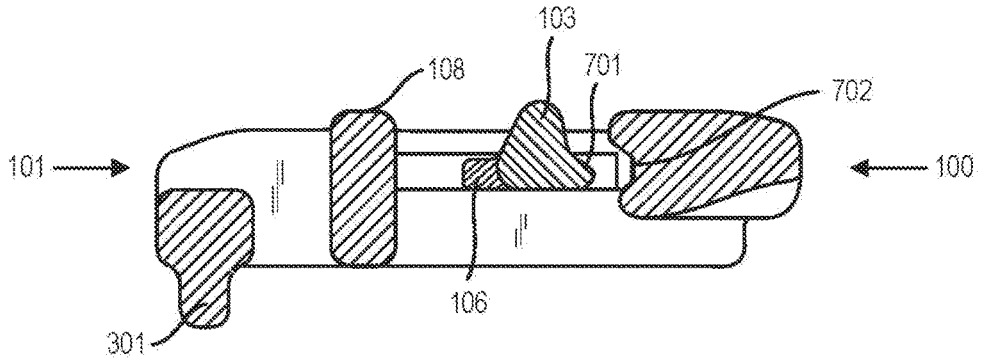
FIG. 7. is a cross section view of the buckle of the present invention.
Figure 8:
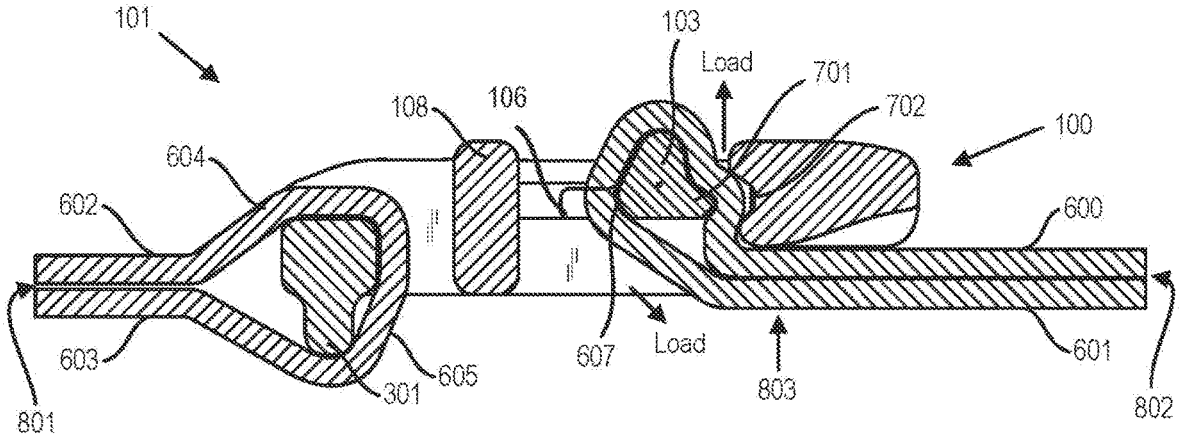
FIG. 8. is a cross section view of the buckle of the present invention.

As shown in FIGS. 6-7, the protrusion 301 is positioned to create a gap between the strap or belt portions 604 and 605. This gap prevents the buckle from flipping up when in the locked position. As shown in FIG. 8, the load occurs at 801 when the belt is in use. When the upper strap 600 is loose, there is no load at 802, when the lower strap is tight 601, the load occurs around 803. Without the protrusion 301, the loads 801 and 803 would not be on the same plane and the belt would not be even. In the preferred embodiment, the bottom edge of the protrusion 301 is rounded to reduce friction against strap or belt portion 605.

Turning to FIG. 7, in the cross section view of the buckle along the longitudinal axis, a male joint portion 701 extends outward from the central bar 103 along the longitudinal axis of the primary plane of the adjustable loop end 100 and towards the first strap or belt opening. A female joint portion 702 is recessed into the adjustable loop end 100 along the longitudinal axis of the primary plane of the adjustable loop end 100 and away from the first strap or belt opening. The adjustable loop end 100 and the fixed loop end 101 and separated by cross bar segment 108. The protrusion 301 is shown extending at about a right angle with respect to the vertical axis of the fixed loop end 101.

Turning to FIG. 8, a cross section view of the buckle along the longitudinal axis, the male joint portion 701 and female joint portion 702 work in concert to keep the central bar 103 from rotating when the strap or belt portion 600 is threaded through the bottom side of the adjustable loop end 100, through the strap or belt opening 102A (shown in FIGS. 1-2) and over the central bar 103, then back through strap or belt opening 102B (shown in FIGS. 1-2) towards the bottom side of the adjustable loop end 100 such that strap or belt portions 600 and 601 are in a stacked parallel configuration. Additionally, the protrusion 301 is positioned to create a gap between the strap or belt portions 604 and 605 when strap or belt portion 602 is threaded through strap or belt opening 102C (shown in FIGS. 1-2) towards the bottom side of the fixed loop end 100 and over the protrusion 301 such that strap or belt portion 602 and 603 are in a stacked parallel configuration and preferably stitched in a fixed position. Additionally, strap or belt portion 603 may be threaded over the protrusion 301 then through strap or belt opening 102C towards the top side of the fixed loop end 100 and over such that strap or belt portion 602 and 603 are in a stacked parallel configuration and preferably stitched in a fixed position.

Turning to FIGS. 2 and 3, the fixed loop end 101 and the adjustable loop end 100 are connected to each other as one contiguous piece to create a common primary plane which are separated by cross bar segment 108. A pair of tabs 106 and 107 are on opposite ends of the central bar 103 extending outward from the leading edge 607 of the central bar 103 along a longitudinal axis of the primary plane of the adjustable loop end 100 and towards the second strap or belt opening 102B. The distance from the back edge 606 to the leading edge 607 of the central bar 103 defines a first central bar length 608. The distance from the back edge 606 of the central bar 103 to the leading edge 609 of each tab 106, 107 defines a second central bar length 611. As shown in FIGS. 2 and 3, the second central bar length 611 is greater than the first central bar length 608. In a conventional buckle without these tabs 106 and 107, the leading edge 607 of the central bar 103 presses into buckle. In the buckle of the present invention, the tabs distribute the load on back edge of central bar 103. Additionally, the tabs 106 and 107 prevent the central bar 103 from rotating when under pressure.

Figure 13:
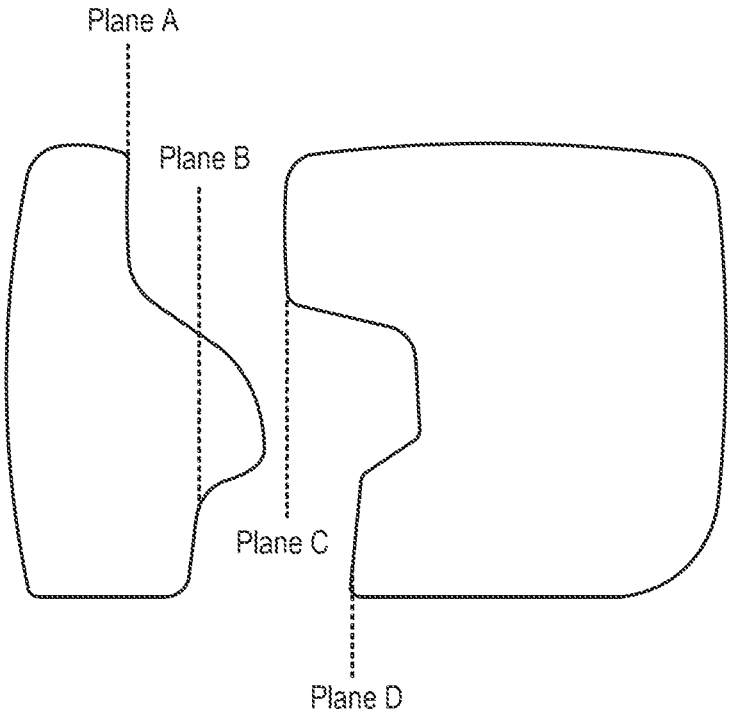
FIG. 13. is a side view of the male and female locking joint of the present invention.

Turning to FIG. 13, the male and female portions of the belt buckle locking mechanism is shown in detail. While a buckle with a male and female portion is common in the prior art, the present invention is novel in that Plane A is offset from Plane B and similarly Plane C is offset from Plane D. These offsets limit the rotation experienced by the locking bar when the belt is inserted and tightened. Looking at FIG. 9, this is demonstrated wherein the top end portions 900 and 903 of the female joint portion is more recessed than the bottom end portion 901 and 904. In an alternative embodiment, the male and female joint portions may be switched such that the locking bar has a female joint that slides over the male joint of the opposing side walls.

Figure 14A:
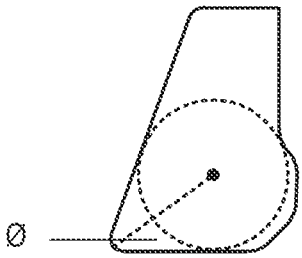
FIG. 14A Prior Art
FIG. 14A. is a side view of the leading edge of the locking bar in the prior art.
Figure 14B:
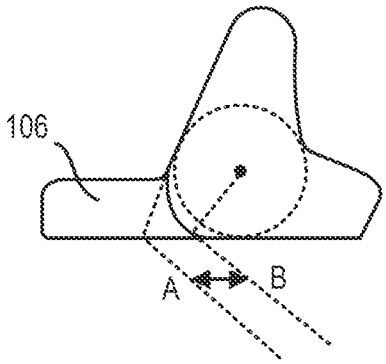
FIG. 14B. is a side view of the leading edge of the locking bar of the present invention.

Turning to FIG. 14A, the traditional leading edge of the male component of the locking bar for most belt buckles is shown with a radius extending outward towards the edge. In this configuration, the load point between the belt and bar is shared with the load point between the bar and frame. Turning to FIG. 14B, the curved nature of the leading edge of the male portion of the present invention results in the load radius being shorter, which reduces the rotating leverage (i.e. there is a reduction between points A and points B). In the present invention, there is a delta between the load points, the delta being created by removing the 0 angle seen in most belt buckles so that the larger reshaped surface area meets the belt.

A buckle according to the invention demonstrates particularly high resilience. When the fixed loop end 101 and the adjustable loop end 100 is made from basic bodies comprising aluminum, as preferred, the buckle according to the invention can achieve loads far exceeding conventional buckles with basic bodies made from aluminum fail to reach such high strength.

A buckle according to the invention can be used, for example, for safety strap or belts for fall protection or for safety strap or belts for aviation sport, particularly for hang-gliding and paragliding. The buckle is also useful for tactical gear usages including, but not limited to, belts, back pack straps, climbing, repelling, harnesses, dog collars and harnesses and cargo straps.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the method (and components of the individual operating components of the method) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections might be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A buckle comprising:

an adjustable loop end forming a primary plane with a pair of opposing side walls with an interior surface and an exterior surface;

a first strap or belt opening extending through the adjustable loop end along a portion of a lateral axis of the primary plane;

a second strap or belt opening extending through the adjustable loop end along a portion of the lateral axis of the primary plane;

a central bar positioned between the first strap or belt opening and the second strap or belt openings along the lateral axis of the primary plane, wherein the central bar comprises a leading edge, a back edge, and two opposing ends, wherein the distance from the back edge to the leading edge are defined by a first central bar length along the longitudinal axis of the primary plane; and a pair of tabs disposed on the opposing ends of the central bar extending from the leading edge of the central bar along a longitudinal axis of the primary plane within the second strap or belt opening, wherein the distance from the back edge of the central bar to a leading edge of the tabs is defined as a second central bar length, wherein the second central bar length is greater than the first central bar length.

2. The buckle of claim 1 further comprising a scalloped lip along a leading edge of a lower surface of the adjustable loop end.

3. The buckle of claim 1 further comprising a fixed loop end connected to the adjustable loop end.

4. The buckle of claim 3 wherein the fixed loop end and adjustable loop end are fixedly connected as one contiguous piece.

5. The buckle of claim 3 further comprising a protrusion extending from a lower surface of the fixed loop end wherein the protrusion is positioned at a right angle with respect to a vertical axis of the primary plane.

6. The buckle of claim 1 further comprising a male joint portion extending outward from the central bar along the longitudinal axis of the primary plane and towards the first strap or belt opening and a female joint portion recessed into the adjustable loop end along the longitudinal axis of the primary plane and away from the first strap or belt opening.

* * * * *